US010032532B2

(12) United States Patent
Forsythe et al.

(10) Patent No.: US 10,032,532 B2
(45) Date of Patent: Jul. 24, 2018

(54) SHIELDING CURTAIN ASSEMBLY FOR AN ELECTROMAGNETIC RADIATION SCANNING SYSTEM

(71) Applicant: Globe Composite Solutions, Ltd., Stoughton, MA (US)

(72) Inventors: Carl W. Forsythe, Cohasset, MA (US); Brian Charles Evans, Marshfield, MA (US)

(73) Assignee: Globe Composite Solutions, Ltd., Stoughton, MA (US)

( * ) Notice: Subject to any disclaimer, the term of this patent is extended or adjusted under 35 U.S.C. 154(b) by 0 days.

(21) Appl. No.: 15/385,024

(22) Filed: Dec. 20, 2016

(65) Prior Publication Data

US 2017/0178759 A1 Jun. 22, 2017

Related U.S. Application Data

(60) Provisional application No. 62/270,741, filed on Dec. 22, 2015, provisional application No. 62/312,066, filed on Mar. 23, 2016.

(51) Int. Cl.
*G21F 3/00* (2006.01)
*G21F 1/02* (2006.01)

(52) U.S. Cl.
CPC . *G21F 3/00* (2013.01); *G21F 1/02* (2013.01)

(58) Field of Classification Search
USPC ..... 250/519.1, 515.1
See application file for complete search history.

(56) References Cited

U.S. PATENT DOCUMENTS

| | | | | |
|---|---|---|---|---|
| 4,020,346 | A | 4/1977 | Dennis | |
| 4,312,396 | A * | 1/1982 | McKinnon | E06B 3/80 160/184 |
| 4,581,538 | A * | 4/1986 | Lenhart | G21F 3/00 250/515.1 |
| 4,635,699 | A | 1/1987 | Kauffman et al. | |
| 4,938,233 | A * | 7/1990 | Orrison, Jr. | A61B 6/107 128/849 |
| 6,548,570 | B1 | 4/2003 | Lange | |
| 8,487,029 | B2 * | 7/2013 | Wang | C08K 3/08 264/126 |
| 9,728,290 | B2 * | 8/2017 | Weed | G21F 3/00 |

FOREIGN PATENT DOCUMENTS

| | | |
|---|---|---|
| CN | 102290108 A | 12/2011 |
| DE | 102005057428 B3 | 8/2007 |

OTHER PUBLICATIONS

EPO Search Report and Written Opinion for EP 16205725.1 dated Sep. 8, 2017 (12 pages).

* cited by examiner

*Primary Examiner* — Phillip A Johnston
(74) *Attorney, Agent, or Firm* — Crowe & Dunlevy; Andre M. Szuwalski

(57) ABSTRACT

Embodiments herein disclose a shielding curtain that is configured to block electromagnetic radiation from passing through it. The shielding curtain may be a flap portion of a larger shielding curtain or a single, unitary body that includes a single mounting bead and a plurality of flaps. The shielding curtain is formed of a polymer material that has a uniformly dispersed particulate material. Electromagnetic radiation emitted by an inspection system is blocked by the uniformly dispersed particulate material.

26 Claims, 9 Drawing Sheets

SHIELDING CURTAIN ASSEMBLY FOR AN ELECTROMAGNETIC RADIATION SCANNING SYSTEM

PRIORITY CLAIM

This application claims priority to U.S. Provisional Patent Application No. 62/270,741, filed on Dec. 22, 2015, and entitled "Integrated Mounting Feature for X-Ray Shielding Curtains," and to U.S. Provisional Patent Application No. 62/312,066, filed on Mar. 23, 2016, and entitled "Molded in Features for X-Ray Shielding Curtains," the disclosures of which are incorporated by reference.

TECHNICAL FIELD

This disclosure relates in general to systems for efficiently and safely scanning luggage, packages, parcels, personal items, and the like, and, and, in particular, but not by way of limitation, to an electromagnetic radiation scanning system that includes shielding curtains with features to simplify manufacturing, assembly, and replacement of the shielding curtains.

BACKGROUND

Electromagnetic radiation, for example X-ray radiation, is used to examine the contents of luggage and parcels prior to allowing such items to be taken on or loaded on transport vehicles or before allowing entry into buildings or other facilities. X-ray scanning machines continuously convey luggage, parcels, cargo, and personal items that are exposed to X-ray radiation that can penetrate the container and can be used to create an image of the contents of the container. Packages and luggage of all shapes and sizes are accommodated by the same scanning system.

Radiation is contained within the scanning system by shielding curtains disposed at the entrance and exit of the scanning system. Conventional shielding curtains are fabricated in a laminated construction. Rolls of material scrim, lead vinyl, lead rubber, and Teflon/nylon are fed from rolls and each becomes a layer of a thin sheet of material. The lead vinyl is sandwiched between Teflon/nylon layers. The continuous strip is wound on a spool and then cut into individual strips. The individual strips are then secured by one or two metal bars or attachment devices and arranged adjacent to each other such that a series of parallel individual strips hang in front of an entrance or exit of the scanning machine and collectively contain or deflect the X-rays within the machine, such that workers are not exposed to potentially harmful X-rays. The lead content of the strips is selected to block the radiation generated in a particular application. The layered construction of the curtain strips forms uniform thickness strips that are free of surface texture.

Sandwiching the individual strips of layered construction between two generally flat bars forms the X-ray shielding curtain. Each of the bars includes a plurality of through holes. A fastener is received through the front bar, and extends through a hole formed through the layered strip, and through the rear bar or attachment bar located on the X-ray scanning system. The holes in the layered construction strips are generally formed after the strips are constructed but before the strips are sandwiched between the clamping bars. Misplacement or misalignment of an individual curtain strip with respect to an adjacent curtain strip may lead to unwanted radiation leakage through a curtain bank.

An example scanning system is disclosed in U.S. Pat. No. 4,020,346, issued on Apr. 26, 1977, entitled "X-Ray Inspection Device and Method," which is hereby incorporated by reference. The '346 patent discloses a scanning system with two banks of shielding arranged parallel to each other to block the entrance to the scanning system, and two banks of shielding curtains arranged parallel to each other to block the exit to the scanning system. However, scanning systems for different applications, such as pre-shipping parcel or cargo inspection may have greater strength radiation, and therefore may have additional banks of radiation shielding curtains positioned at the entrance and exit.

Parcels, luggage, or personal items that are conveyed through the scanning system displace the strips of curtains. In certain applications, a light parcel may be required to simultaneously displace two or more banks of curtains. If the parcel is too light to displace multiple curtain banks, a back-up may occur on the system that must be addressed by a worker. As should be obvious, curtains with a greater stiffness are not as easily displaced as curtains that are more flexible. Also, friction between the curtains and the parcel must be overcome so the parcel can move through the scanning system. Finally, the layered construction strip curtains wear, which can lead to unwanted material, including lead, being rubbed off onto the luggage or parcels. Of course, worn shielding curtains need to be replaced.

SUMMARY

Embodiments herein disclose a shielding curtain that is configured to block electromagnetic radiation from passing through it. The shielding curtain may be a flap portion of a larger shielding curtain or a single, unitary body that includes a single integrated mounting bead and a plurality of flaps. The shielding curtain is formed of a polymer material that has a uniformly dispersed particulate material. According to certain embodiments, the shielding curtain is molded from a composite polymer material that includes a thermosetting polymer material and the uniformly dispersed particulate material. Electromagnetic radiation emitted by an inspection system is blocked by the uniformly dispersed particulate material.

A shielding curtain assembly includes a curtain suspending member with a slot that extends along a length of the curtain suspending member. A shielding curtain that blocks electromagnetic radiation is suspended by the curtain suspending member. The shielding curtain is formed of a polymer material, such as a thermosetting polymer, and a particulate filler material, such as Tungsten powder and/or Barium sulfate. According to certain embodiments, the shielding curtain includes a mounting bead that is received in the slot and a plurality of flaps that extend from the mounting bead. The mounting bead and the plurality of flaps may be a single, unitary body.

Shielding curtains according to the present disclosure may be disposed at an entrance end or an exit end of an exposure station of an X-ray inspection system that emits electromagnetic radiation, for example X-ray radiation, to inspect the contents of luggage or shipping parcels. Each end of the inspection system may include multiple shielding curtains.

Technical advantages of shielding curtains for electromagnetic radiation scanning systems according to the teachings of the present disclosure include mounting features that are directly molded into a unitary curtain with a plurality of flaps. The molded in mounting features facilitate easy installation, removal, and replacement of shielding curtains in existing inspection systems. In addition, the molded shielding curtains allow a surface texture of the flaps to be molded into the shielding curtain, which may reduce the coefficient of friction and/or the surface area of the shielding curtain that comes into contact with the package, parcel, or personal item to allow the item to more easily pass through the shielding curtain.

Other technical advantages include the elimination of lead and replacement of lead containing curtains with a composite polymer material with a lead equivalency. The composite polymer material may be more flexible than conventional leaded layered construction curtains and may have a lower coefficient of friction. Lower frictional force and increased curtain flexibility results in increased throughput of packages, parcels, personal items, cargo, or luggage and also results in fewer jams or other stoppage of the inspection equipment.

Other technical advantages will be readily apparent to one of ordinary skill in the art from the following figures, descriptions, and claims. Moreover, while specific advantages have been described above, various embodiments may include all, some, or none of the enumerated advantages.

BRIEF DESCRIPTION OF THE FIGURES

The accompanying drawings facilitate an understanding of the various embodiments.

DETAILED DESCRIPTION

Figure 1:
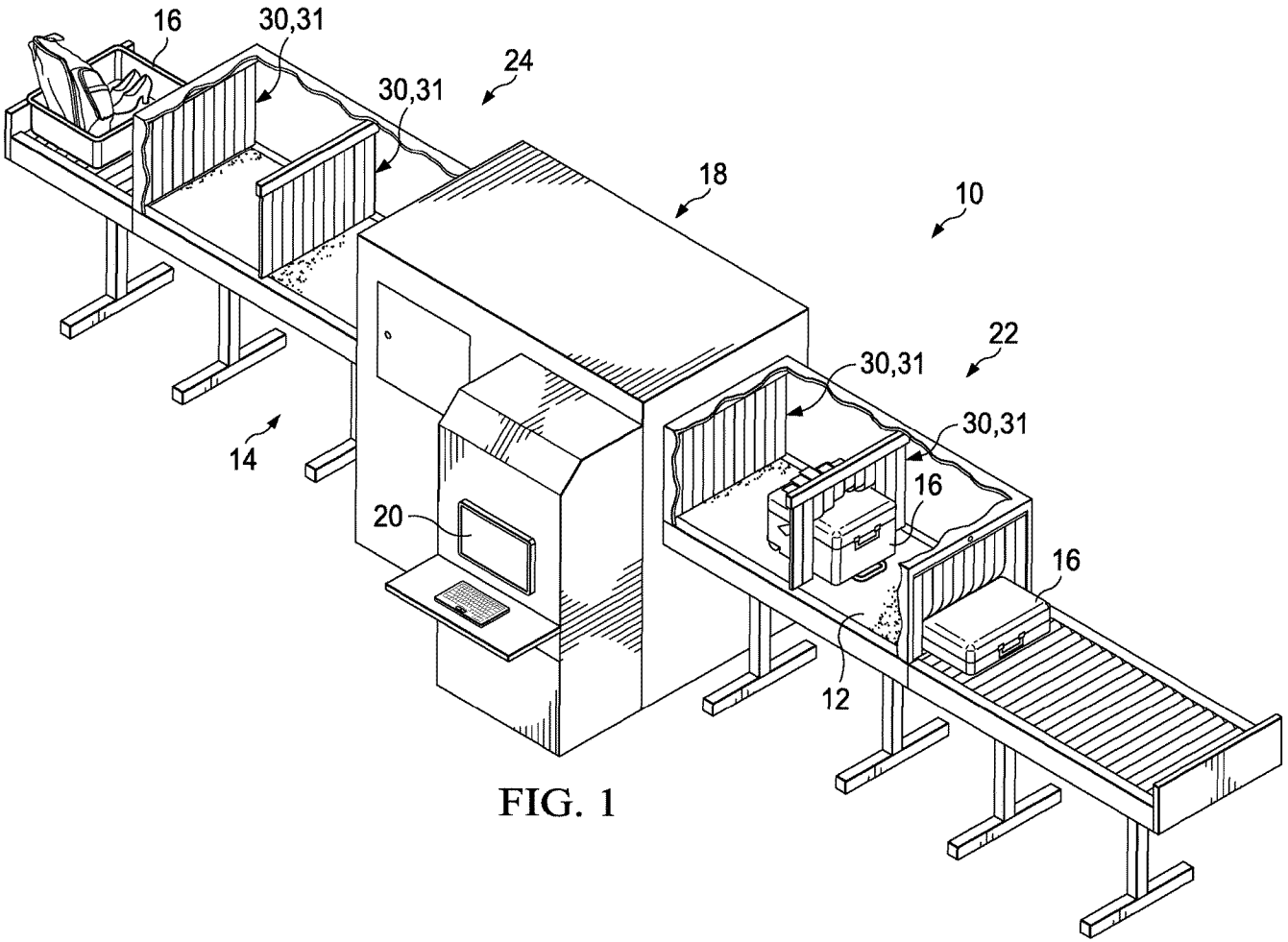
FIG. 1 is a perspective view of an electromagnetic radiation scanning system.

FIG. 1 is a perspective view of an electromagnetic radiation scanning system 10 according to the teachings of the present disclosure. The scanning system 10 may also be referred to as an inspection system. The electromagnetic radiation scanning system 10 includes a conveyor belt 12 that is supported by a support structure 14. The conveyor belt 12 conveys items 16 into an exposure station 18 where the item 16 is exposed to electromagnetic radiation that penetrates the item and provides an image of its contents. A worker views the image created by the penetrating electromagnetic radiation on a monitor 20 and can determine whether the item 16 should be further inspected.

The item 16 may be luggage, a personal item, a package, or a parcel for shipping, or other container where an initial examination determines that the item is safe to transport or enter a facility and does not contain contraband. The item 16 may also be inspected to determine whether it contains items controlled by airport security regulations or other security protocol. For example the United States Transportation Security Administration may use an electromagnetic radiation scanning system 10 to inspect for explosive devices or other controlled items. The electromagnetic radiation may be in any suitable form for creating an image of the contents of a container. For example, the electromagnetic radiation may be x-rays, gamma rays, and the like. X-ray electromagnetic radiation is often used in scanning systems to inspect baggage and parcels.

To protect individuals near the electromagnetic radiation scanning system 10, such as transportation, shipping, or security workers, the electromagnetic radiation should be contained within the exposure station 18. Therefore, the exposure station 18 is includes a material that is impenetrable by the particular emitted electromagnetic radiation. It is known to use lead to contain electromagnetic radiation, such as X-rays. The exposure station 18 includes an open entrance end 22 and exit end 24 that allow the conveyor belt 12 to continuously move the items 16 into and out of the exposure station 18. One or more shielding curtains 30 are disposed at the entrance end 22 and the exit end 24 of the exposure station 18 to block electromagnetic radiation from escaping into the ambient environment.

In addition to blocking electromagnetic radiation, the shielding curtains are also configured to be displaced by the items 16 on the conveyor belt 12. Each shielding curtain 30 includes a plurality of flaps 32 that are displaced by the items 16. The shielding curtains 30 block the electromagnetic radiation from breaching the entrance end 22 and the exit end 22, but the flaps 32 of the shielding curtain 30 are flexible enough to be displaced by the items 16 moved by the conveyor belt 12. By displacing the flaps 32 of the shielding curtains 30 at the entrance end 22, the item 16 enters the exposure station 18 where it is safely exposed to electromagnetic radiation. After the exposure, the conveyor belt 12 moves the item 16 such that it displaces the flaps 32 of the shielding curtains 30 at the exit end 24 where the items 16 can be safely further handled.

The shielding curtains 30 are coupled to the exposure station 18 such that they hang or are otherwise positioned to extend across and block the open entrance end 22 and the open exit end 24 of the exposure station 18. The shielding curtains 30 may be passive in that they hang and the item displaces the shielding curtain in order to pass through, or the shielding curtain 30 may be active in that mechanical actuation, usually automatic actuation, displaces the shielding curtain to allow items to pass.

In certain embodiments, multiple shielding curtains 30 are disposed parallel to each other and each shielding curtain 30 must be traversed for an item 16 to be scanned by the system 10. This configuration further contains the electromagnetic radiation such that if the electromagnetic radiation escapes through an inner shielding curtain 30 that escaped electromagnetic radiation can be blocked by one or more outer shielding curtains 30. Any suitable number of shielding curtains may be positioned to block the entrance end 22 and the exit end 24. According to one embodiment, four to eight shielding curtains 30 are disposed parallel to each other at the entrance end 22 of the exposure station 18 and four to eight shielding curtains 30 are disposed at the exit end 24 of the exposure station 18. The slits 34 forming the individual flaps 32 of a shielding curtain 30 may be staggered with respect to adjacent shielding curtains 30 to further prevent the electromagnetic radiation from escaping the exposure station 18. According to alternate embodiments, the shielding curtain 30 may be mechanically actuated to open and close to allow the item 16 to pass through to a location where it can be exposed to electromagnetic radiation.

Figure 2:
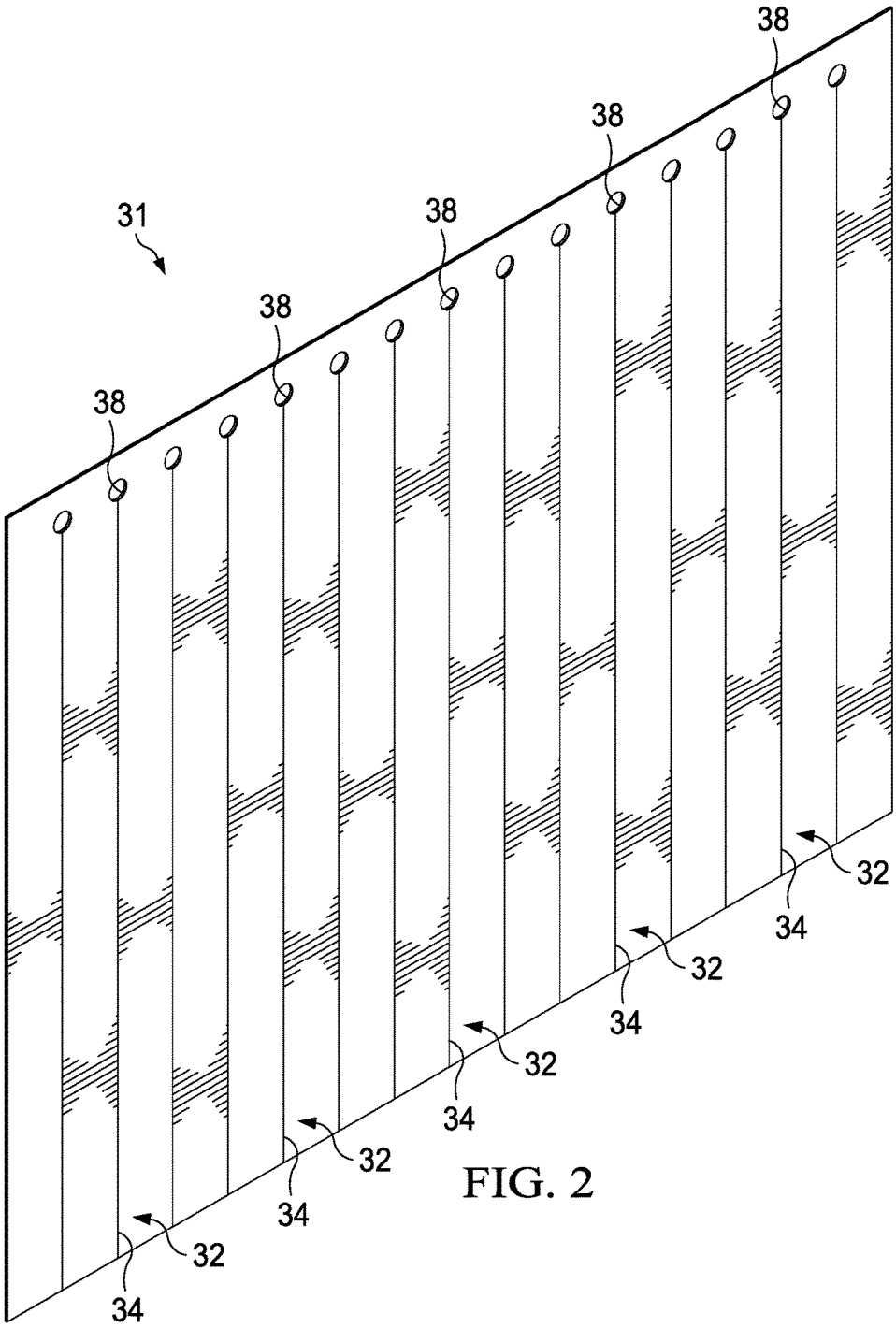
FIG. 2 is a perspective view of a shielding curtain molded from a composite polymer material.

Reference is now made to FIG. 2, which is a perspective view of a shielding curtain 31 according to the teachings of the present disclosure. The shielding curtain 31 is a single homogeneous, unitary body that is molded from a composite polymer material, as discussed in more detail below. According to one embodiment, the single, unitary body includes a plurality of flaps 32, as shown in FIG. 2. According to an alternate embodiment, the shielding curtain 31 may be formed from individually molded flaps that are molded from a composite polymer material. The shielding curtain 31 does not include molded-in mounting features. As such, the shielding curtain 31 may be mounted conventionally with fasteners received through the curtain and through a pair of clamping bars disposed on the front and the rear of the top edge of the shielding curtain 31. Certain advantages are obtained by molding the shielding curtain 31 including the plurality of flaps 32 or individual flaps 32 from a composite polymer material, as opposed to forming flaps using conventionally layered construction. For example, the composite polymer material may be more flexible than conventional leaded layered construction curtains and may have a lower coefficient of friction.

Figure 3A:
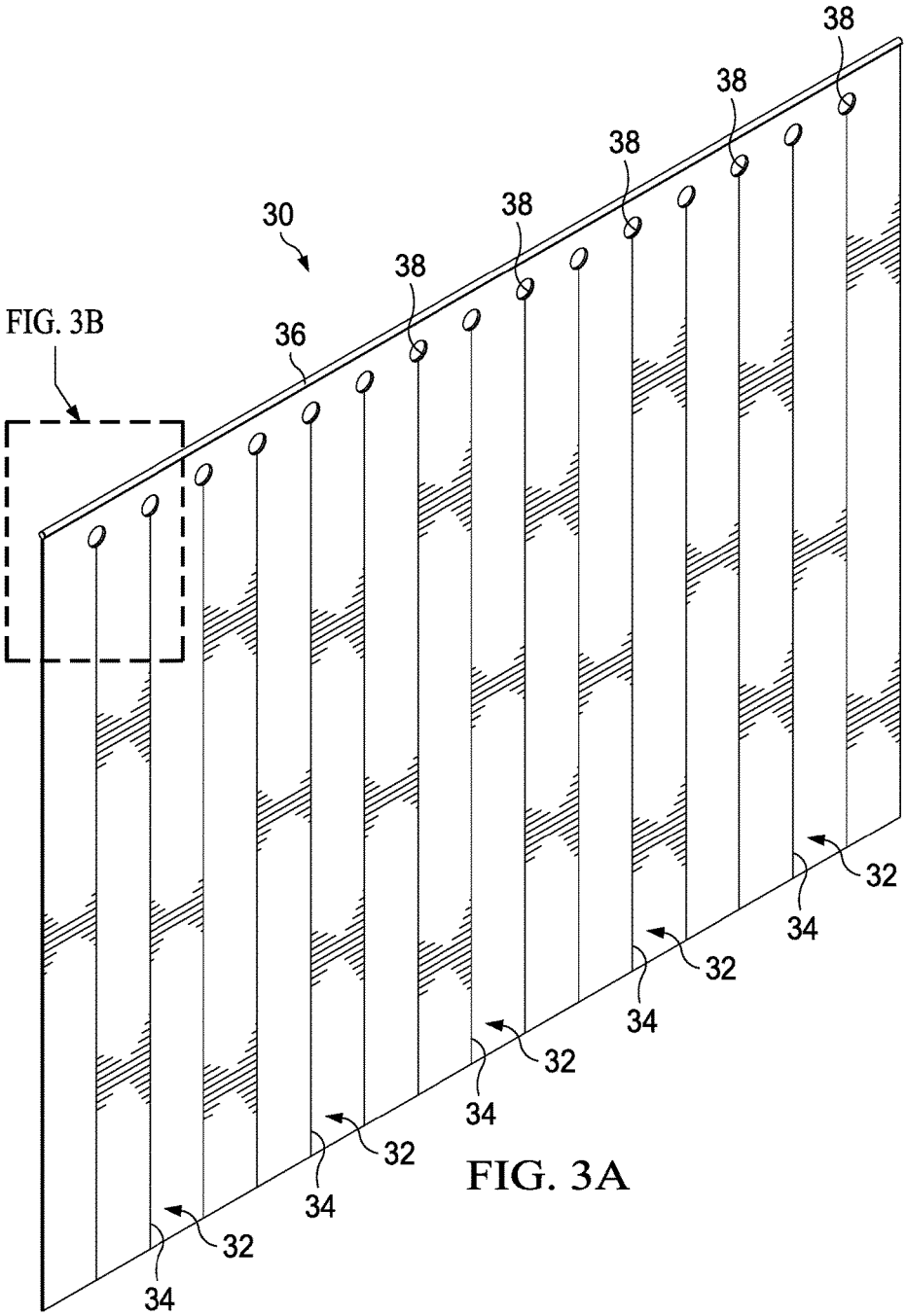
FIGS. 3A-3B are perspective views of a shielding curtain that is molded from a composite polymer material and includes an integrated mounting bead
Figure 3B:
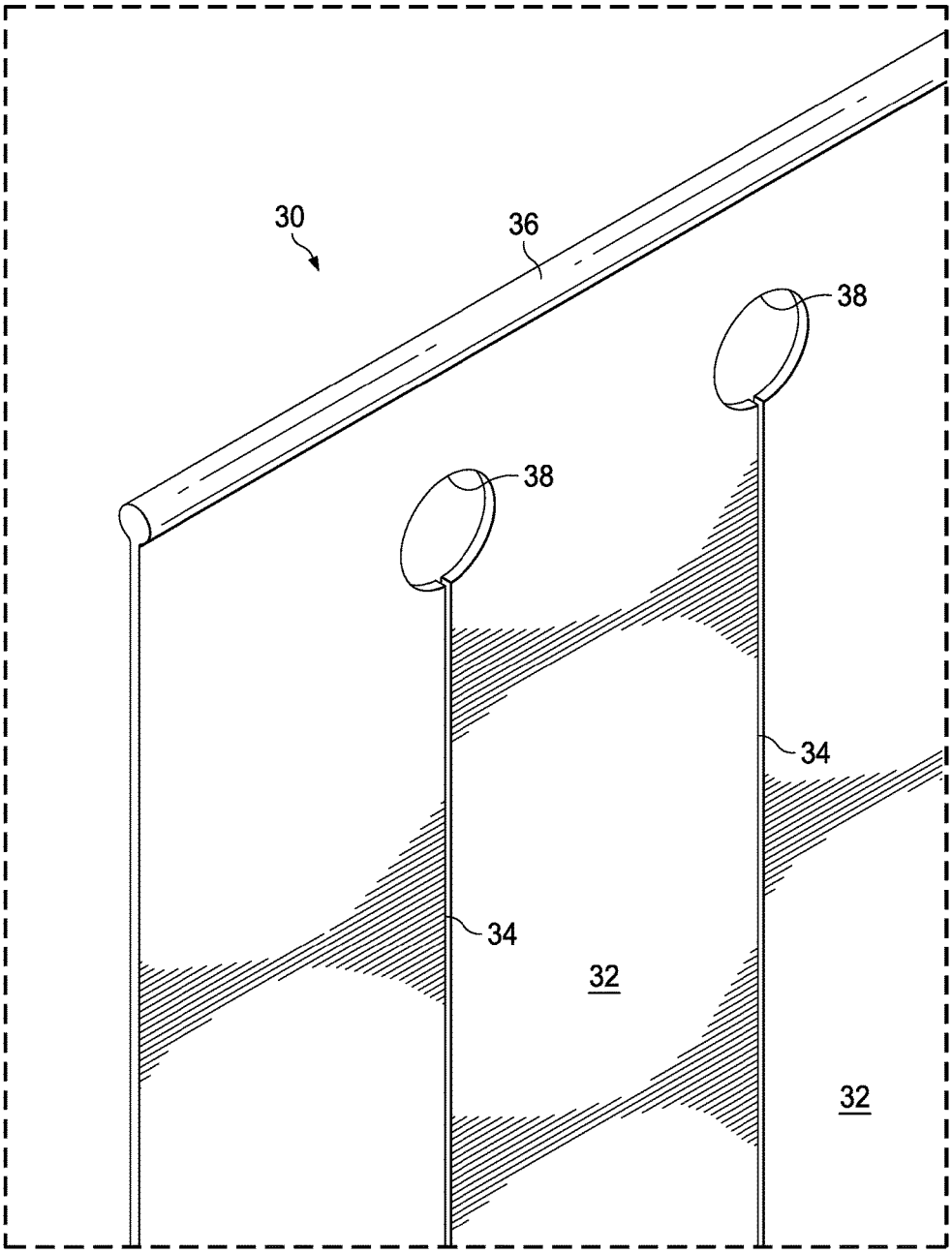

Reference is made to FIGS. 3A and 3B, which are perspective views of a shielding curtain 30 with a molded-in mounting feature 36. The shielding curtain 30 may be a single, unitary body that includes a plurality of flaps, or it may be a single flap 32 with a portion of the molded-in mounting feature 36. The shielding curtain 30 includes an integrated mounting bead 36 as the molded-in mounting feature, and the shielding curtain 30 includes the plurality of flaps 32 extending from the mounting bead 36.

The shielding curtain 30 and the shielding curtain 31 are each formed using a polymer fabrication process, such as injection molding, compression molding, casting, extrusion, and the like. The material that is molded or cast into the shielding curtain 30, 31 may be a composite polymer material, a lead vinyl material, or a lead rubber material. An exemplary composite polymer material includes a thermosetting polymer such as urethane and one or more heavy particulate filler, such as Tungsten powder, and/or one or more light particulate filler, such as Barium sulfate, and is sold under the trade name Brandonite. The filler material is in the form of particles or powder that is uniformly dispersed in the polymer material. Such composite polymer material is introduced into a mold as pellets or as liquid, and then formed into the desired flap or shielding curtain according to the teachings of the present disclosure. For example, a composite polymer material includes a filler material that includes either Tungsten powder or Barium sulfate or both materials in particle form that is uniformly dispersed in a urethane or other polymer. Other suitable polymers and particulate fillers are contemplated by the present disclosure.

U.S. Pat. No. 8,487,029 to Wang and assigned to Globe Composite Solutions, Ltd., which is hereby incorporated by reference, describes materials and forming processes for composite polymer materials that result in a lead-free, non-toxic article that is particularly useful in radiation shielding applications. In addition, the composite polymer material is flexible to allow the item 16 to displace the flaps 32 of the shielding curtain 30, 31, while at the same time providing a barrier for the electromagnetic radiation. The shielding curtain 30, 31 formed of a composite polymer material may be compliant with the directive as to Restriction of Hazardous Substances ("RoHS").

The flaps 32 may be any thickness, for example, each flap 32 may be approximately 0.075 inches thick. Electromagnetic radiation shielding equivalency or lead equivalency corresponds to the thickness of the flaps 32 of the shielding curtain 30. For example, 1 millimeter in flap thickness corresponds to approximately 0.25 millimeters (0.010 inches) in lead equivalency. Certain embodiments of the shielding curtain 30, 31 have a uniform thickness of approximately 0.075 inches (1.9 millimeters), which corresponds to approximately 0.5 millimeters (0.020 inches) in lead equivalency. Accordingly, the shielding curtains 30, 31 can have any suitable thickness depending on the desired lead equivalency, provided that the flaps 32 remain flexible enough to be displaced by the items 16 as the items pass through the shielding curtain 30, 31.

The mounting bead 36 is generally cylindrical or oblong and extends along the length of an upper edge of the shielding curtain 30. The flaps 32 are integral with the mounting bead 36 and hang from the mounting bead 36. According to an alternate embodiment, the mounting bead 36 may be molded around a reinforcing rod. Any suitable number of flaps 32 may extend from the mounting bead 36. For example, 10-16 flaps 32 or more may extend from the mounting bead 36.

According to one embodiment, the mounting bead 36 and a pre-cut sheet extending from the mounting bead 36 is formed according to known polymer forming processes, such as molding, casting, or extrusion. The material formed may be a composite polymer material, a lead vinyl material, or a lead rubber material. Then, the sheet is cut to form a predetermined number of flaps 32 by cutting the slits 34 through the sheet such that the slits 34 extend from the bottom of the sheet to a location proximate the mounting bead 36, but the mounting bead 36 is not cut, such that the shielding curtain remains a single, unitary body. According to certain embodiments, the shielding curtain 30 is not cut into flaps 32. Rather, the shielding curtain 30 may be a single sheet extending from the mounting bead 36. The single sheet embodiment may be employed as an active shielding curtain, which may be useful shielding cargo that is exposed to electromagnetic radiation. In the active shielding curtain embodiment, the shielding curtain is automatically mechanically actuated to open and close to allow items to pass through.

Returning to the multiple-flap embodiment, each slit 34 separates one flap 32 from an adjacent flap 32. The slits 34 may be made by an automated cutting system that is known in the machining art, such as a water jet, laser jet, cutting blade, and the like that automatically makes the flap forming slits 34 according to a software program. According to an alternate embodiment, a single flap 32 including a flap-sized mounting bead 36 may be formed, and then combined with other individually formed flaps 32 in an assembly according to the teachings of this disclosure to form a shielding curtain.

Figure 6A:
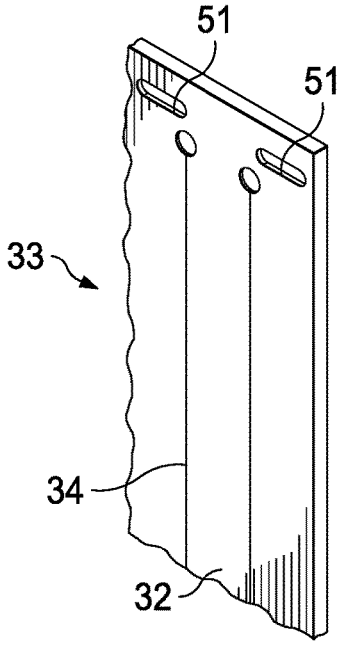
FIGS. 6A-6C are perspective views of various molded-in mounting features that may be incorporated into a shielding curtain according to the teachings of the present disclosure.
Figure 6B:
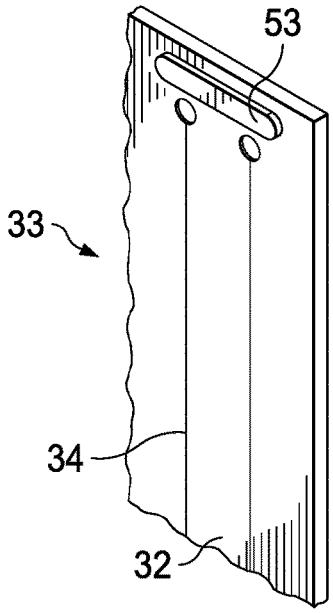
Figure 6C:
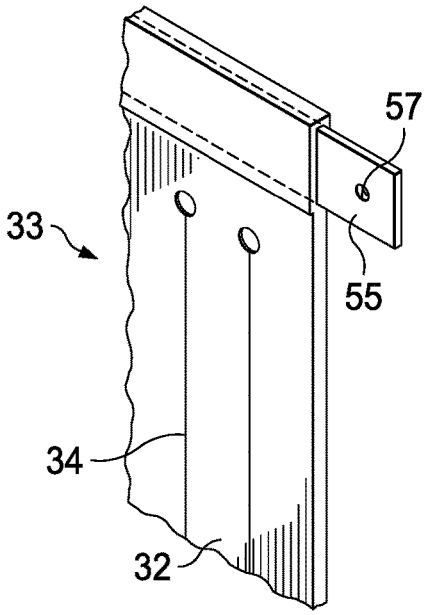

With regard to the single, unitary body shielding curtain 30 with the plurality of flaps, either with or without (see FIG. 2) the mounting bead 36 or other molded-in mounting features (see FIGS. 6A-6C, a strain relief hole 38 may be formed at an upper end of the slit 34 proximate the upper edge of the shielding curtain 31 or the mounting bead 36. The strain relief holes 38 delimit each flap forming slit 34 and prevent the cut from propagating further toward the mounting bead 36 or the upper edge as the shielding curtain 30, 31 is flexed during use. The strain relief holes 38 may present a path for the electromagnetic radiation to breach a shielding curtain 30. Staggering the strain relief holes 38 in adjacent and/or successive shielding curtains 30 installed at the entrance end 22 or exit end 24 of the exposure station 18 helps prevent the electromagnetic radiation from escaping and entering the ambient environment. Additionally or in lieu of staggering the shielding curtains 30, the strain relief holes 38 may be aligned with a portion of the exposure station 18, which may prevent or reduce the electromagnetic radiation from passing through the strain relief holes 38.

Figure 4A:
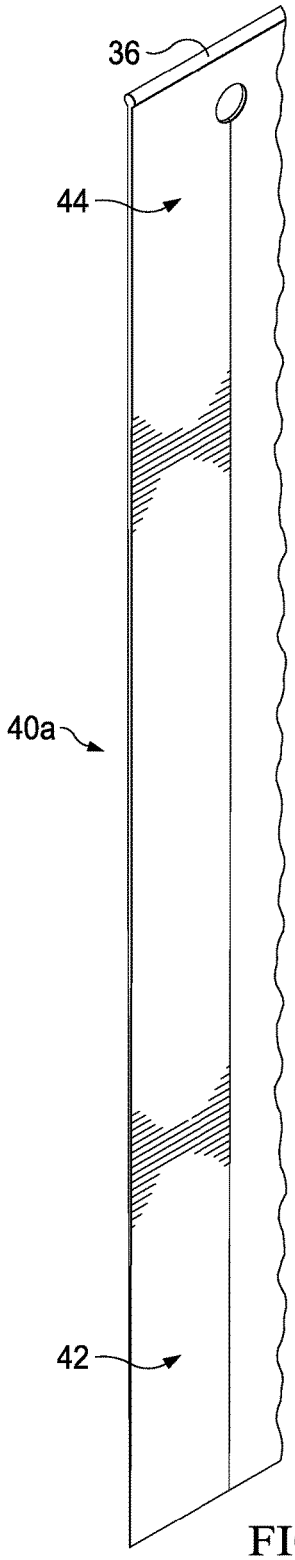
FIGS. 4A-4B are perspective views of alternate embodiments of flaps of shielding curtains that include varied thickness.
Figure 4B:
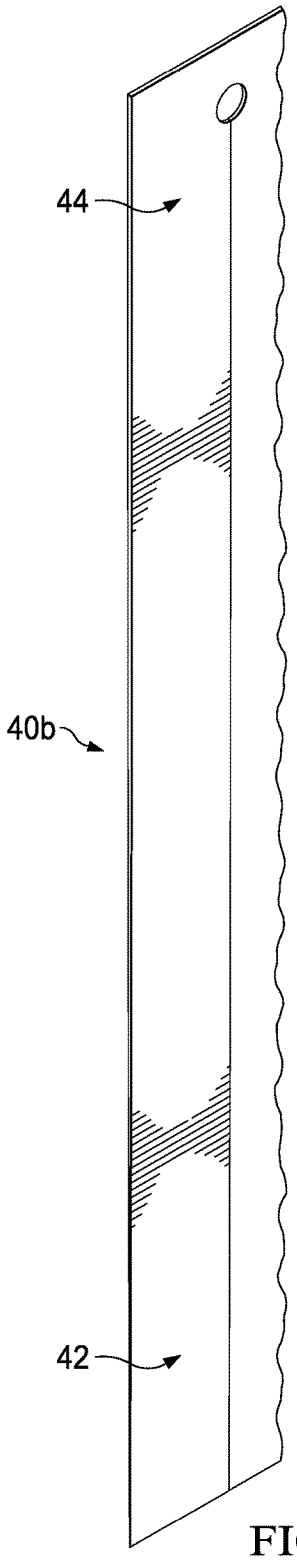

Reference is now made to FIGS. 4A and 4B, which are perspective views of an alternate flap configuration for the shielding curtain 31 without the mounting bead and for the shielding curtain 30, including the mounting bead 36 or other molded-in mounting feature. Each flap 32 of the shielding curtain may have a uniform thickness, as shown and described above with respect to FIGS. 2, 3A, and 3B, or a flap may have a varied or non-uniform thickness. A non-uniform thickness flap 40*a* is formed using the molding, casting, or extrusion processes of polymer forming and includes the mounting bead 36 or other molded-in mounting feature. And, a non-uniform thickness flap 40*b* does not include molded-in mounting features. Such non-uniform thickness flap 40*a*, 40*b* is an advantage over the layered strip flaps of conventional shielding curtains.

The varied thickness in the flap may be implemented to provide varying lead equivalency for shielding against electromagnetic radiation. For example, the flap 40*a*, 40*b* may taper from a thicker, upper portion to a thinner, lower portion. A lower portion 42 of the varied thickness flap 40*a*, 40*b* may be thinner and have a lower lead equivalency and be less effective at blocking electromagnetic radiation than an upper portion 44. The upper portion 44 may have a greater thickness than the lower portion 42, and thus have a greater lead equivalency and be more effective in preventing electromagnetic radiation from penetrating the thicker portion of the flap 40*a*, 40*b*. Alternatively, the flap 40*a*, 40*b* may taper from a thicker, lower portion to a thinner. The upper portion 42 of the varied thickness flap 40*a*, 40*b* may be thinner and have a lower lead equivalency and be less effective at blocking electromagnetic radiation than a lower portion 44. The lower portion 44 may have a greater thickness than the upper portion 42, and thus have a greater lead equivalency and be more effective in preventing electromagnetic radiation from penetrating the thicker portion of the flap 40*a*, 40*b*.

By employing a varied or non-uniform thickness flap 40*a*, 40*b* shielding curtain, different zones may be made thicker to shield more effectively against the electromagnetic radiation than other zones. The different zones may be selected to accommodate the particular shielding application depending on an emission pattern and strength of the electromagnetic radiation. In addition, the electromagnetic radiation scanning system 10 may be equipped with different varied thickness flaps 40 shielding curtains at different locations at the entrance end 22 and/or the exit end 24 of the exposure station 18. According to an alternate embodiment, individual varied thickness flaps 40*a*, 40*b* may be formed by molding, casting, or extrusion of a composite polymer material, a lead vinyl material, or a lead rubber material and then subsequently assembled to form a shielding curtain.

Figure 5A:
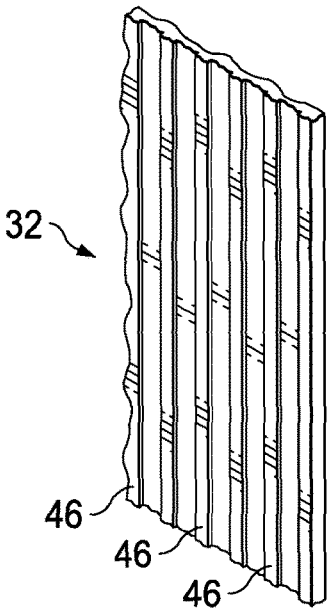
FIGS. 5A-5C are perspective views of various friction reducing surface textures that may be incorporated into a contact surface of the flaps of the shielding curtains according to the teachings of the present disclosure.
Figure 5B:
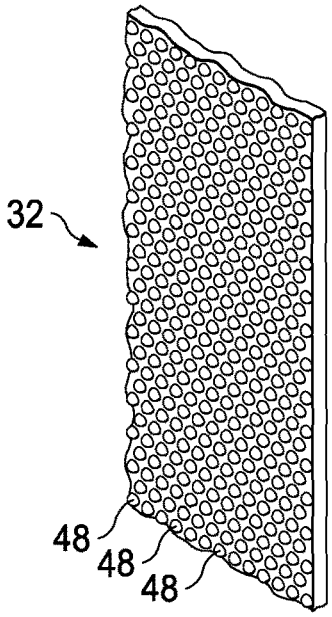
Figure 5C:
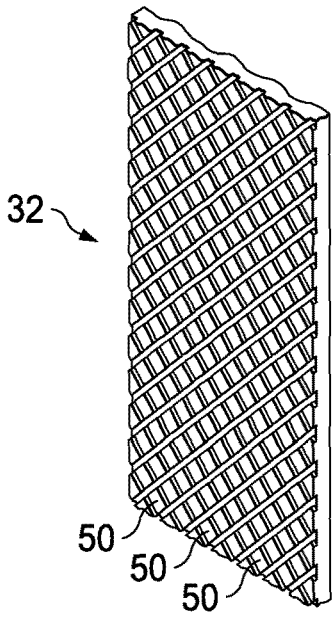

Reference is now made to FIGS. 5A-5C, which show various surfaces of the flaps 32 of a shielding curtain 30, 31 according to embodiments of the present disclosure. The surfaces of the flaps are the surfaces that are contacted by the items 16 moved by the conveyor belt 12 through the electromagnetic radiation scanning system 10. For example, as shown in FIG. 5A, a flap 32 may have a surface feature in the form of raised contact projections 46 that extend either parallel or perpendicular to the slits 34. In another embodiment shown in FIG. 5B, a raised contact feature may be in the form of a plurality of raised bosses or dome-shaped projections 48. According to yet another embodiment shown in FIG. 5C, the raised contact features are raised parallelepipeds 50. Each of the raised contact features, the raised strips 46, the raised dome-shaped projections 48, and the raised parallelepipeds 50 provide a contact surface area that is reduced from the overall surface area of the flap 32. In this manner, friction and drag between the conveyed item 16 displacing the flaps 32 and the flaps 32 is reduced and wear of the flaps 32 may also be reduced over conventional layered shielding curtains. The raised surface features described herein could also be depressions molded into the flaps 32 of the shielding curtain 30. The surface features of FIGS. 5A-5C may be employed with any of the shielding curtain or individual flap embodiments disclosed herein. Such surface features are formed by creating a mold with the negative of the desired surface feature, then molding the curtain or individual flap from the composite polymer material including the filler material that blocks electromagnetic radiation but remains flexible to be displaced by the items. Surface area reducing surface features are not easily formed in the fabrication process of conventional layered construction shielding curtains. The raised features may also be used to indicate the level of wear of the shielding curtains in use.

Reference is now made to FIGS. 6A-6C, which are perspective views of portions of a shielding curtain 33 with various molded-in mounting features that may be used in lieu of the molded-in mounting bead depending on the particular curtain mounting features associated with the scanning system where original or replacement shielding curtains or original or replacement individual flaps are installed. Molded-in mounting features as shown and described with respect to FIGS. 6A-6C are included in the mold and created when the composite polymer material is formed by the mold. In this manner, few or no additional fabrication operations may be necessary for the shielding curtain or an individual flap to be mounted to a shielding curtain assembly that is ultimately installed in an electromagnetic radiation scanning system.

FIG. 6A illustrates through holes 51 that have been molded into an upper portion of the shielding curtain 33. The through holes 51 may also be molded into individual flaps 32 of the shielding curtain. The through holes 51 may be any shape or size such that they correspond to the mounting features for the shielding curtain assembly or to allow for horizontal or vertical adjustment of the shielding curtains with respect to the specific mounting configuration. Protrusions 53 or bosses as shown in FIG. 6B may also be molded into the top portion of the shielding curtain 33 or individual flaps 32. The protrusions 53 may be any suitable size and shape that corresponds with mounting features or to allow for horizontal or vertical adjustment of the shielding curtains with respect to the specific mounting configuration for the particular scanning system. FIG. 6C illustrates molded-in mounting hardware 55. The mounting hardware 55 may be a generally elongated flat bar that extends through the shielding curtain 33. According to certain embodiments, the mounting hardware 55 extends such that it is exposed on each side of the shielding curtain 33 where an exposed mounting feature 57, such as a through hole, may be used to secure the shielding curtain 33 or to allow for horizontal or vertical adjustment of the shielding curtain with respect to the specific mounting configuration of the scanning system. The composite polymer material is bonded to the mounting hardware 55 because the liquid composite polymer material in the mold forms around the mounting hardware such that when the piece is taken out of the mold, the shielding curtain 33 or an individual flap 32 is bonded to the mounting hardware 55. According to an alternate embodiment, the shielding curtain 33 may not envelop or encapsulate all sides of the mounting hardware, but rather may be molded to be bonded to one front or rear surface of the mounting hardware 55. Other mounting hardware that may be molded into the shielding curtain or individual flaps include, but are not limited to, threaded inserts, fasteners, washers, bushings, pins, and the like.

Figure 7:
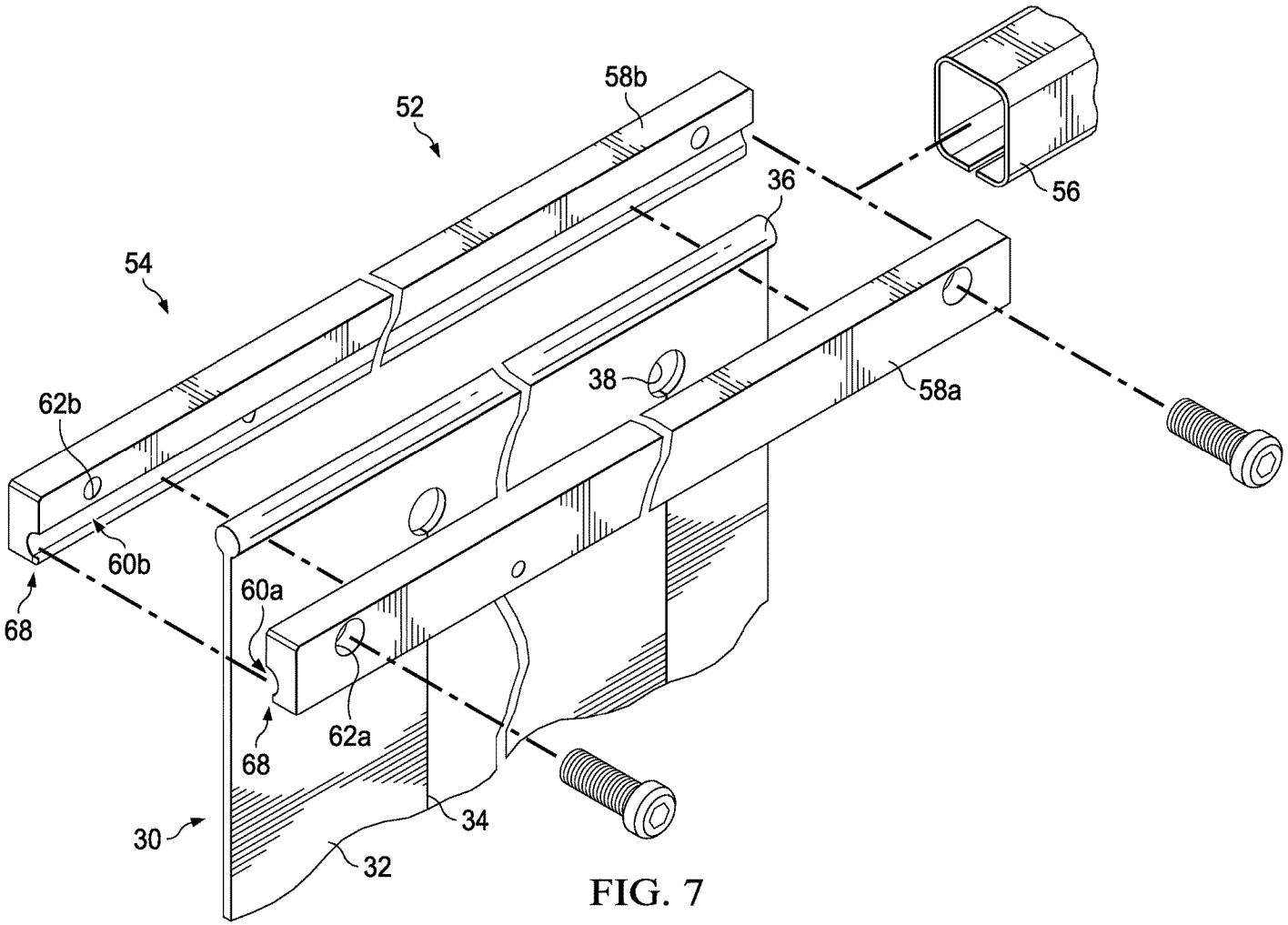
FIG. 7 is a perspective view of an embodiment of a shielding curtain assembly including a multi-piece shielding curtain support member and a shielding curtain.

Reference is now made to FIG. 7, which is an exploded, perspective view of a shielding curtain assembly 52 according to the teachings of the present disclosure. The shielding curtain assembly 52 includes the shielding curtain 30 and a multi-piece curtain suspending member 54 that supports the shielding curtain 30. When assembled, the curtain suspending member 54 receives the mounting bead 36 of the shielding curtain 30. The multi-piece curtain suspending member 54 is received by a mounting channel 56 that is secured to the electromagnetic radiation scanning system 10. According to certain embodiments, the mounting channel 56 is accessible through at least one access door disposed on one or both sides or on the top of the scanning system 10. The mounting channel 56 may be the same as in conventional electromagnetic scanning systems so as to allow the shielding curtain assembly 52 of the present disclosure to be easily retrofit to existing and in-use scanning systems.

The multi-piece curtain suspending member 54 includes a front bar 58*a* and a rear bar 58*b*, where front and rear refer generally to the direction of travel of the items 16 on the conveyor belt 12 that encounter the shielding curtain 30. Each of the front and rear bars 58*a*, 58*b* defines a generally semi-circular recess 60*a*, 60*b* disposed at a lower portion of each bar 58*a*, 58*b*. Disposed above the semicircular recess 60*a*, 60*b* on each bar 58*a*, 58*b* is a plurality of fastening holes 62*a*, 62*b*. When the bars 58*a*, 58*b* are abutted together, fasteners are received through the fastening holes 62*a*, 62*b* to join the bars 58*a*, 58*b* to form the multi-piece curtain suspending member 54, which includes a bead receiving slot 64. The shape of the bead receiving slot 64 corresponds to the shape of the mounting bead 36 on the shielding curtain 30 such that the mounting bead 36 is received by and supported by the bead receiving slot 64.

Unlike conventional shielding curtains that are clamped between generally flat bars and secured therebetween by fasteners that penetrate the shielding curtain, no fasteners penetrate the mounting bead 36 or any other part of the shielding curtain 30. Rather, an upward facing portion 66 of the bead receiving slot 64 contacts an underside of the mounting bead 36 and the weight of the shielding curtain 30 is opposed by the upward facing portion 66 of the bead receiving slot 64 and the mounting bead 36 is held in the bead receiving slot 64.

In this manner, the shielding curtain 30 is more easily initially assembled and replaced than conventional shielding curtains. The mounting bead 36 and the corresponding bead receiving slot 64 need not be cylindrical, and any suitable shape for the mounting bead 36 and the corresponding bead receiving slot 64 is contemplated by this disclosure, including, but not limited to cross-sections of the mounting bead having a shape generally in the form of square, rectangle, oval, triangle, and the like. In addition, the shielding curtain formed with a composite polymer material allows the installed shielding curtain 30 to be curved. The mounting bead 36 may likewise be curved or wavy along the length of the shielding curtain 30. According to an alternate embodiment, the flexibility of the molded composite polymer material allows the mounting bead 36 and the shielding curtain 30 to be generally straight, but when installed into a curved or wavy mounting slot, the curtain then has a curved or wavy configuration as it extends across the entrance end 22 or the exit end 24 of the exposure station 18.

The flaps 32 of the shielding curtain 30 are received through an incomplete portion 68 of the generally circular slot 64 disposed at the bottom of the slot 64. The slot 64 also functions as a pivot for the collective flaps 32. Thus, the slot 64 and mounting bead 36 junction provides rotational freedom for the movement of the collective flaps 32 of the shielding curtain 30, which may reduce stresses on the shielding curtain 30 imparted as the items 16 displace and flex the flaps 32 of the shielding curtain 30. Such stress relief may result in a longer useful life of the shielding curtain 30.

The joining of the front and rear bars 58*a*, 58*b* also forms a generally elongated outer rectangular shape that corresponds to the shape of the mounting channel 56 of the electromagnetic radiation scanning system 10. According to an alternate embodiment, an exterior of the front and/or rear bars 58*a*, 58*b* or other curtain suspending member may include any suitable mounting feature that corresponds to the scanning system. For example, one or both of the bars 58*a*, 58*b* may include an angle bar that includes through holes that correspond to tapped or non-tapped through holes on the scanning system.

The front bar 58*a* and the rear bar 58*b* may each be a metal part where the generally semi-circular recesses 60*a*, 60*b* and the fastener holes 62*a*, 62*b* are machined into a blank piece of metal, for example a blank of steel or aluminum, to form the final front and rear bars 58*a*, 58*b*. In one example, a fastener hole 62*a*, 62*b* in either the front or rear bar 58*a*, 58*b* may be tapped to receive a threaded fastener. According to other embodiments, the front bar 58*a* and the rear bar 58*b* may be formed of various plastics or fiberglass and may include a bearing-type material and/or a lubricant proximate the slot to facilitate rotation of the mounting bead 36 within the slot 64, as described above.

According to an alternate embodiment, the multi-piece curtain suspending member receives individual flaps 32 that are each formed with a mounting bead 36 with a shape that corresponds to the bead receiving slot 68. The individual flaps 32 are positioned to be adjacent to each other to minimize a distance between adjacent flaps 32 through which electromagnetic radiation may pass, yet each individual flap 32 is free to flex and be displaced separately such that the item can pass through the shielding curtain 30. The receiving slot 68 may also allow the shielding curtain 30 to move laterally more freely to act as a swinging hinge to permit items to pass through the shielding curtain 30 and enter or exit the exposure station 18.

Figure 8:
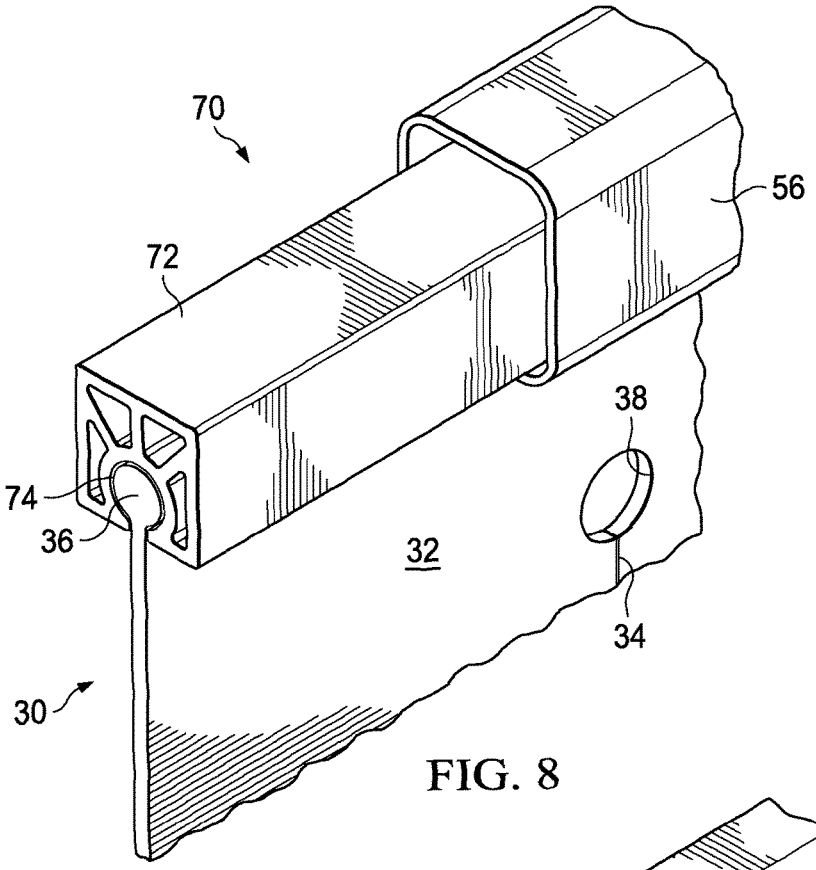
FIG. 8 is a perspective view of an alternate embodiment of a shielding curtain assembly including a single piece shielding curtain support member and a shielding curtain.

Reference is now made to FIG. 8, which is an exploded, perspective view of an alternate embodiment of a shielding curtain assembly 70. The curtain receiving assembly 70 includes a curtain receiving bar 72, which functions as a curtain suspending member, and the shielding curtain 30. The curtain receiving bar 72 is a single, unitary elongated member that includes an incomplete circular slot 74, similar to that described above with respect to the multi-piece curtain support 54 of FIG. 5. The incomplete circular slot 74 is sized and shaped to receive the mounting bead 36 of the shielding curtain 30 to allow the collective flaps 32 to be suspended to block the entrance end 22 or the exit end 24 of the radiation exposure station 18. The mounting bead 36 and the slot 74 may be any suitable shape as describe above with respect to the embodiment shown in FIG. 7.

Unlike conventional shielding curtains that are clamped between generally flat bars and secured therebetween by fasteners that penetrate the shielding curtain, no fasteners penetrate the mounting bead 36 or any other part of the shielding curtain 30. Rather, an upward facing portion 76 of the incomplete circular slot 74 contacts and underside of the mounting bead 36 and the weight of the shielding curtain 30 is opposed by the upward facing portion 76 of the incomplete circular slot 74 and the mounting bead 36 is held in the incomplete circular slot 74. In this manner, the shielding curtain 30 is more easily initially assembled and replaced than conventional shielding curtains. The mounting bead 36 and the corresponding incomplete circular slot 74 need not be cylindrical, and any suitable shape for the mounting bead 36 and the corresponding slot 74 is contemplated by this disclosure, including, but not limited to cross-sections of the mounting bead having a shape generally in the form of square, rectangle, oval, triangle, and the like.

The flaps 32 of the shielding curtain 30 are received through an incomplete portion 78 of the incomplete circular slot 74 disposed at the bottom of the slot 74. The slot 74 also functions as a pivot for the collective flaps 32. Thus, the slot 74 and mounting bead 36 junction provides rotational freedom for the movement of the collective flaps 32 of the shielding curtain 30, which may reduce stresses on the shielding curtain 30 imparted as the items 16 displace and flex the flaps 32 of the shielding curtain 30. Such stress relief may result in a longer useful life of the shielding curtain 30.

The outer shape of the curtain receiving bar 72 is generally shaped in an elongated rectangular shape to correspond to the mounting channel 56 secured above and across the entrance end 22 and the exit end 24 of the exposure station 18. As described above, the mounting channel 56 may be similar to those found in existing and in-use electromagnetic radiation scanning systems, which facilitates retrofitting existing systems with replacement shielding curtain assemblies 70 according to the teachings of the present disclosure.

According to certain embodiments, the curtain receiving bar 72 is an elongated, thin walled member that may be formed by extrusion of a polymer or metallic material, such as aluminum, a composite polymer material, a thermosetting polymer, or a thermoplastic polymer. According to other embodiments, the curtain receiving bar 72 is a metallic or polymer material formed by a different molding process other than extrusion, such as injection molding. The curtain receiving bar 72 may be any suitable length, for example it may have a length of between 35 inches and 50 inches, for example approximately 40 inches. The curtain receiving bar 72 may be extruded and/or cut to any suitable length to span across the entrance end 22 or exit end 24 of the exposure station 18 of the electromagnetic radiation scanning system 10.

According to an alternate embodiment, the curtain receiving bar 72 receives individual flaps 32 that are each formed with a mounting bead 36 with a shape that corresponds to the incomplete circular slot 74. The individual flaps 32 are positioned to be adjacent to each other to minimize a distance between adjacent flaps 32 through which electromagnetic radiation may pass, yet each individual flap 32 is free to flex and be displaced separately such that the item can pass through the shielding curtain 30.

Figure 9:
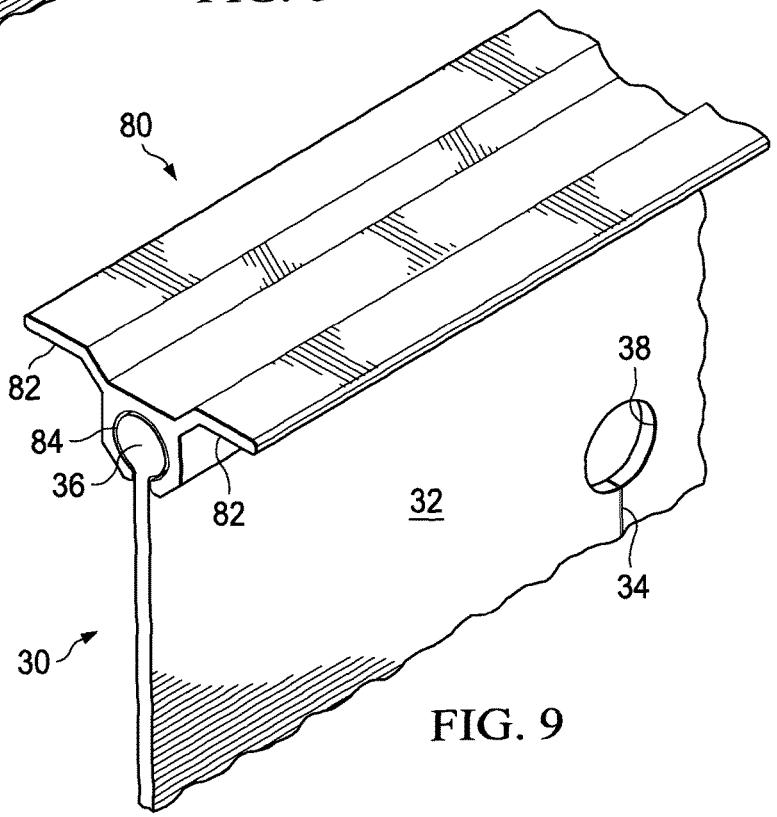
FIG. 9 is a perspective view of an alternate embodiment of a shielding curtain support member.

Reference is now made to FIG. 9, which illustrates an alternate embodiment of a single-piece curtain receiving bar 80. The single-piece curtain receiving bar 80 has a different profile geometry than the curtain receiving bar 72 shown in FIG. 8. The curtain receiving bar 80 includes a pair of flanges 82 extending proximate a top portion of the curtain receiving bar 80. The flanges 82 are configured to receive a fastener to secure the curtain receiving bar 80 to the exposure station 18 of the electromagnetic radiation scanning system 10. Similar to the embodiment shown in FIG. 6, the curtain receiving bar 80 includes a bead receiving slot 84, and it is a generally thin-walled part formed by injection molding, pultrusion, or extrusion of a polymer or a metallic material. This disclosure contemplates any suitable extrusion profile that can be mounted to the electromagnetic radiation scanning system 10 and includes a bead receiving slot 84 that receives the mounting bead 36 of the shielding curtain 30. A single unitary body shielding curtain 30 with a mounting bead 36 or individual flaps 32 of a shielding curtain may be received and held in place by the single-piece curtain receiving bar 80, similar to the embodiments described above with respect to FIGS. 7 and 8. According to an alternate embodiment, a top portion of the curtain receiving bar may be open to allow the shielding curtain to be dropped in from above the curtain receiving bar such that the bead receiving slot supports and suspends the mounting bead 36 or other integrated mounting feature.

In the foregoing description of certain embodiments, specific terminology has been resorted to for the sake of clarity. However, the disclosure is not intended to be limited to the specific terms so selected, and it is to be understood that each specific term includes other technical equivalents which operate in a similar manner to accomplish a similar technical purpose. Terms such as "left" and right", "front" and "rear", "above" and "below," "top" and "bottom" and the like are used as words of convenience to provide reference points and are not to be construed as limiting terms.

In addition, the foregoing describes only some embodiments of the invention(s), and alterations, modifications, additions and/or changes can be made thereto without departing from the scope and spirit of the disclosed embodiments, the embodiments being illustrative and not restrictive.

Furthermore, invention(s) have been described in connection with what are presently considered to be the most practical and preferred embodiments, it is to be understood that the invention is not to be limited to the disclosed embodiments, but on the contrary, is intended to cover various modifications and equivalent arrangements included within the spirit and scope of the invention(s). Also, the various embodiments described above may be implemented in conjunction with other embodiments, e.g., aspects of one embodiment may be combined with aspects of another embodiment to realize yet other embodiments. Further, each independent feature or component of any given assembly may constitute an additional embodiment.

What is claimed is:

1. An apparatus, comprising:

at least a portion of a unitary body comprising a molded-in mounting feature integral with a plurality of flaps of a curtain configured to block electromagnetic radiation from passing through the curtain, the curtain comprising a polymer material and a particulate material uniformly dispersed therein.

2. The apparatus of claim 1 wherein the polymer material is a urethane and the particulate material is at least one of Tungsten powder and Barium sulfate.

3. The apparatus of claim 1 wherein the polymer material is a thermosetting polymer.

4. The apparatus of claim 1 wherein mounting feature is a mounting bead and the plurality of flaps extend from the mounting bead.

5. The apparatus of claim 1 wherein the plurality of flaps includes a surface texture configured to reduce a surface area contacted by an item displacing the plurality of flaps.

6. The apparatus of claim 1 wherein each of the plurality of flaps defines a varied thickness.

7. The apparatus of claim 1 wherein each of the plurality of flaps defines a uniform thickness.

8. A shielding curtain assembly, comprising:

a curtain suspending member defining a slot extending along a length of the curtain suspending member; and a shielding curtain comprising at least one flap extending from and integral with a mounting bead configured to be received by the slot to thereby suspend the shielding curtain, the shielding curtain comprising a polymer material and a particulate material uniformly dispersed therein.

9. The shielding curtain assembly of claim 8 wherein the at least one flap is a plurality of flaps.

10. The shielding curtain assembly of claim 9 wherein the mounting bead and the plurality of flaps are a single, unitary body.

11. The shielding curtain assembly of claim 8 wherein the at least one flap is a separate body including a portion of the mounting bead.

12. The shielding curtain assembly of claim 8 wherein the at least one flap is a plurality of flaps and the mounting bead and the plurality of flaps are a single, unitary body and a slit separates adjacent flaps and the shielding curtain comprises a plurality of strain relieving holes delimiting respective slits and disposed proximate the mounting bead.

13. The shielding curtain assembly of claim 8 wherein the particulate filler material is at least one of Tungsten powder and Barium sulfate.

14. The shielding curtain assembly of claim 8 wherein the curtain suspending member comprises a first bar fastened to a second bar using fasteners and wherein the fastened bars form the slot configured to receive the mounting bead.

15. The shielding curtain assembly of claim 8 wherein the curtain suspending member comprises only one bar defining the slot configured to receive the mounting bead.

16. A shielding curtain for blocking electromagnetic radiation, comprising:

a mounting bead configured to be received by a slot to suspend the shielding curtain; and a flap being flexible and extending from and integral with the mounting bead.

17. The shielding curtain of claim 16 wherein the flap and the mounting bead comprise a polymer material and a particulate material uniformly dispersed therein.

18. The shielding curtain of claim 16 wherein the flap and the mounting bead comprise at least one of lead vinyl and lead rubber.

19. The shielding curtain of claim 16 wherein the flap comprises a plurality of flaps and the mounting bead and the plurality of flaps are portions of the same single, unitary body.

20. The shielding curtain of claim 19 wherein a slit separates adjacent flaps and the shielding curtain comprises a plurality of strain relieving holes delimiting respective slits and disposed proximate the mounting bead.

21. A shielding curtain, comprising:

a molded body comprising a molded-in mounting feature that is integral with at least one flap extending from the molded-in mounting feature, wherein the molded body comprises a flexible composite polymeric material configured to block electromagnetic radiation.

22. The shielding curtain of claim 21 wherein the molded-in mounting feature is a mounting bead.

23. The shielding curtain of claim 21 wherein the molded-in mounting feature comprises at least one through hole.

24. The shielding curtain of claim 21 wherein the molded-in mounting feature comprises at least one protrusion.

25. The shielding curtain of claim 21 wherein the molded-in mounting feature comprises mounting hardware.

26. The shielding curtain of claim 25 wherein the mounting hardware comprises a generally elongated, flat bar.

* * * * *